US009458816B2

(12) United States Patent
Aida

(10) Patent No.: US 9,458,816 B2
(45) Date of Patent: Oct. 4, 2016

(54) INTERNAL COMBUSTION ENGINE IGNITION APPARATUS

(71) Applicant: Mitsubishi Electric Corporation, Tokyo (JP)

(72) Inventor: Futoshi Aida, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 345 days.

(21) Appl. No.: 13/768,711

(22) Filed: Feb. 15, 2013

(65) Prior Publication Data

US 2014/0090628 A1 Apr. 3, 2014

(30) Foreign Application Priority Data

Oct. 2, 2012 (JP) ..... 2012-220069

(51) Int. Cl.

| | |
|---|---|
| ***F02P 3/02*** | (2006.01) |
| ***F02P 15/10*** | (2006.01) |
| ***F02P 3/08*** | (2006.01) |
| ***F02P 15/00*** | (2006.01) |

(52) U.S. Cl.

CPC ..... *F02P 15/00* (2013.01); *F02P 3/0892* (2013.01); *F02P 15/10* (2013.01)

(58) Field of Classification Search

CPC ..... F02P 1/086; F02P 17/00; F02P 11/025; F02P 15/00; F02P 3/10; F02P 3/005; F02P 15/10; F02P 3/0892; Y02T 10/46; F02D 37/02; F02D 2041/2013

USPC ..... 123/594, 620, 621, 622, 623, 640

See application file for complete search history.

(56) References Cited

U.S. PATENT DOCUMENTS

| | | | | | |
|---|---|---|---|---|---|
| 4,547,734 | A | * | 10/1985 | Spaude | F02P 17/12 315/209 M |
| 4,892,080 | A | | 1/1990 | Morino et al. | |
| 5,069,193 | A | * | 12/1991 | Erhard | F02P 1/086 123/335 |
| 5,138,995 | A | * | 8/1992 | Erhard | F02P 1/086 123/335 |
| 5,150,697 | A | * | 9/1992 | Akagi | F02P 3/0869 123/620 |
| 5,193,515 | A | * | 3/1993 | Oota | F02P 15/10 123/604 |
| 5,724,938 | A | * | 3/1998 | Yamada | F02P 15/08 123/169 CL |
| 6,305,365 | B1 | | 10/2001 | Maeoka et al. | |
| 2006/0021607 | A1 | | 2/2006 | Toriyama | |

FOREIGN PATENT DOCUMENTS

| | | | | | |
|---|---|---|---|---|---|
| JP | 1-232165 | A | | 9/1989 | |
| JP | 11-153079 | A | | 6/1999 | |
| JP | 11153079 | A | * | 6/1999 | F02P 3/08 |

(Continued)

OTHER PUBLICATIONS

Japanese Office Action, issued Oct. 1, 2013, Patent Application No. 2012-220069.

*Primary Examiner* — Sizo Vilakazi

(74) *Attorney, Agent, or Firm* — Sughrue Mion, PLLC

(57) ABSTRACT

A resonance inductor is connected with a charging path through which an ignition condenser is charged; a first switching device controls charging of the ignition condenser; discharging of the ignition condenser is controlled by a second switching device whose collector terminal is connected with the other end of the primary coil of an ignition coil unit and whose emitter terminal is connected with the negative-polarity terminal of the ignition condenser; a clamp diode is connected between the one end of the primary coil and the collector terminal of the second switching device.

7 Claims, 6 Drawing Sheets

(56) References Cited * cited by examiner

FOREIGN PATENT DOCUMENTS

| | | |
|---|---|---|
| JP | 2936119 B2 | 8/1999 |
| JP | 4497027 B2 | 7/2010 |

INTERNAL COMBUSTION ENGINE IGNITION APPARATUS

BACKGROUND OF THE INVENTION

1. Field of the Invention

The present invention relates to a capacitive-discharging-method ignition apparatus that is utilized in an internal combustion engine.

2. Description of the Related Art

In recent years, the issues such as environment preservation and fuel depletion have been raised; measures for these issues are urgently required also in the automobile industry. The measures include, as an example, ultra-lean-combustion (referred to also as stratified-lean-combustion) operation of an internal combustion engine that utilizes a stratified air-fuel mixture. In the stratified lean combustion, the distribution of inflammable fuel-air mixtures may vary; therefore, in terms of ignition opportunity, long-period spark discharge is required. The concentration of a fuel-air mixture also varies; thus, in some cases, leakage is likely to occur due to a smolder produced through adhesion of carbon to an ignition plug. From these points of view, for the purpose of securely causing a spark discharge even in such a situation where an energy leakage path is created, it is required to generate a large secondary current in the ignition coil unit.

To date, as an ignition apparatus that generates a large secondary current in an ignition coil unit, there exists, for example, a capacitive-discharging-method ignition apparatus disclosed in FIG. 3 of Patent Document 1. In the conventional ignition apparatus, an LC resonance circuit consisting of a large-capacity condenser, a choke coil, and an ignition condenser (referred to as a CDI condenser, hereinafter) is connected with the output of a DC/DC converter; part of electrostatic energy accumulated in the large-capacity condenser is boosted up to a voltage that is approximately twice as high as the output voltage of the DC/DC converter and the CDI condenser is charged with the boosted electrostatic energy, and then the energy accumulated in the CDI condenser is repeatedly supplied to the primary coil of the ignition coil unit, so that intermittent multi-ignition is applied to the ignition plug. In a conventional ignition apparatus disclosed in Patent Document 2, multi-ignition is implemented by providing a plurality of large-scale energy supply units so as to alternately changing the secondary current of the ignition coil unit.

PRIOR ART REFERENCE

Patent Document

[Patent Document 1] Japanese Patent No. 2936119

[Patent Document 2] Japanese Patent No. 4497027

As is well known, in some times, the inside of the combustion chamber of an internal combustion engine becomes highly fluid and hence the discharge maintaining voltage drastically changes. In this case, there is raised the probability that a blow-off phenomenon in which a spark discharge is interrupted. In the case of such a capacitive-discharging-method ignition apparatus as disclosed in Patent Document 1, intermittent multi-ignition is implemented, as described above; thus, because energy cannot continuously be supplied to an ignition plug, there is posed a problem that the foregoing blow-off phenomenon becomes likely to occur.

The conventional ignition apparatus disclosed in Patent Document 2 is provided with a configuration that generates a larger discharge current; however, because a DC/DC converter having a larger capacity and an energy accumulation coil having a larger capacity are required, there is posed a problem that more heat is generated and the apparatus upsizes.

SUMMARY OF THE INVENTION

The present invention has been implemented in order to solve the foregoing problems in conventional ignition apparatuses; the objective thereof is to provide a small-size inexpensive capacitive-discharging-method ignition apparatus that can cause a dielectric breakdown again, even when a spark discharge is interrupted, and can resume the spark discharge.

An internal combustion engine ignition apparatus according to the present invention includes a power source circuit unit that generates a predetermined output; a resonance inductor connected with the output terminal of the power source circuit unit; an ignition condenser that is charged with the output of the power source circuit unit by way of the resonance inductor; an ignition coil unit provided with a primary coil whose one end is connected with the positive-polarity terminal of the ignition condenser and a secondary coil that is magnetically coupled with the primary coil and generates an ignition voltage when energy produced through discharge of the ignition condenser is supplied thereto; an ignition plug that is provided with a pair of electrodes facing each other through a gap, one of the pair of electrodes of which is connected with the secondary coil, and that produces a spark discharge between the electrodes when the ignition voltage is applied across the pair of electrodes so as to ignite an inflammable fuel-air mixture supplied to an internal combustion engine; a control circuit unit provided with a first switching device connected with a charging path through which the ignition condenser is charged and a second switching device whose collector terminal is connected with the other terminal of the primary coil and whose emitter terminal is connected with the negative-polarity terminal of the ignition condenser; and a first diode connected between the one end of the primary coil and the emitter terminal of the second switching device. The internal combustion engine ignition apparatus is characterized in that based on an ignition signal for the internal combustion engine from the outside, the control circuit unit turns on the first switching device so that the ignition condenser is charged, and based on the ignition signal, the control circuit unit turns on the second switching device so that the ignition condenser is discharged.

An internal combustion engine ignition apparatus according to the present invention includes a power source circuit unit that generates a predetermined output; a resonance inductor connected with the output terminal of the power source circuit unit; an ignition condenser that is charged with the output of the power source circuit unit by way of the resonance inductor; an ignition coil unit provided with a primary coil whose one end is connected with the positive-polarity terminal of the ignition condenser and a secondary coil that is magnetically coupled with the primary coil and generates an ignition voltage when energy produced through discharge of the ignition condenser is supplied thereto; an ignition plug that is provided with a pair of electrodes facing each other through a gap, one of the pair of electrodes of which is connected with the secondary coil, and that produces a spark discharge between the electrodes when the ignition voltage is applied across the pair of electrodes so as to ignite an inflammable fuel-air mixture supplied to an internal combustion engine; a control circuit unit provided with a first switching device connected with a charging path through which the ignition condenser is charged and a second switching device whose collector terminal is connected with the other terminal of the primary coil and whose emitter terminal is connected with the negative-polarity terminal of the ignition condenser; and a second diode connected between the one end of the primary coil and the collector terminal of the second switching device. The internal combustion engine ignition apparatus is characterized in that based on an ignition signal for the internal combustion engine from the outside, the control circuit unit turns on the first switching device so that the ignition condenser is charged, and based on the ignition signal, the control circuit unit turns on the second switching device so that the ignition condenser is discharged.

An internal combustion engine ignition apparatus according to the present invention includes a power source circuit unit that generates a predetermined output; a resonance inductor connected with the output terminal of the power source circuit unit; an ignition condenser that is charged with the output of the power source circuit unit by way of the resonance inductor; an ignition coil unit provided with a primary coil whose one end is connected with the positive-polarity terminal of the ignition condenser and a secondary coil that is magnetically coupled with the primary coil and generates an ignition voltage when energy produced through discharge of the ignition condenser is supplied thereto; an ignition plug that is provided with a pair of electrodes facing each other through a gap, one of the pair of electrodes of which is connected with the secondary coil, and that produces a spark discharge between the electrodes when the ignition voltage is applied across the pair of electrodes so as to ignite an inflammable fuel-air mixture supplied to an internal combustion engine; a control circuit unit provided with a first switching device connected with a charging path through which the ignition condenser is charged and a second switching device whose collector terminal is connected with the other terminal of the primary coil and whose emitter terminal is connected with the negative-polarity terminal of the ignition condenser; and a first diode connected between the one end of the primary coil and the emitter terminal of the second switching device. The internal combustion engine ignition apparatus is characterized in that based on an ignition signal for the internal combustion engine from the outside, the control circuit unit turns on the first switching device so that the ignition condenser is charged, and based on the ignition signal, the control circuit unit turns on the second switching device so that the ignition condenser is discharged. As a result, a high-level secondary current and a long-period spark discharge can be realized, and even when the spark discharge is interrupted, a dielectric breakdown is caused again and hence the spark discharge can be resumed; in addition to that, the apparatus can be downsized.

An internal combustion engine ignition apparatus according to the present invention includes a power source circuit unit that generates a predetermined output; a resonance inductor connected with the output terminal of the power source circuit unit; an ignition condenser that is charged with the output of the power source circuit unit by way of the resonance inductor; an ignition coil unit provided with a primary coil whose one end is connected with the positive-polarity terminal of the ignition condenser and a secondary coil that is magnetically coupled with the primary coil and generates an ignition voltage when energy produced through discharge of the ignition condenser is supplied thereto; an ignition plug that is provided with a pair of electrodes facing each other through a gap, one of the pair of electrodes of which is connected with the secondary coil, and that produces a spark discharge between the electrodes when the ignition voltage is applied across the pair of electrodes so as to ignite an inflammable fuel-air mixture supplied to an internal combustion engine; a control circuit unit provided with a first switching device connected with a charging path through which the ignition condenser is charged and a second switching device whose collector terminal is connected with the other terminal of the primary coil and whose emitter terminal is connected with the negative-polarity terminal of the ignition condenser; and a second diode connected between the one end of the primary coil and the collector terminal of the second switching device. The internal combustion engine ignition apparatus is characterized in that based on an ignition signal for the internal combustion engine from the outside, the control circuit unit turns on the first switching device so that the ignition condenser is charged, and based on the ignition signal, the control circuit unit turns on the second switching device so that the ignition condenser is discharged. As a result, a high-level secondary current and a long-period spark discharge can be realized, and even when the spark discharge is interrupted, a dielectric breakdown is caused again and hence the spark discharge can be resumed; in addition to that, the apparatus can be downsized.

The foregoing and other object, features, aspects, and advantages of the present invention will become more apparent from the following detailed description of the present invention when taken in conjunction with the accompanying drawings.

DETAILED DESCRIPTION OF THE PREFERRED EMBODIMENTS

Embodiment 1

Figure 1:
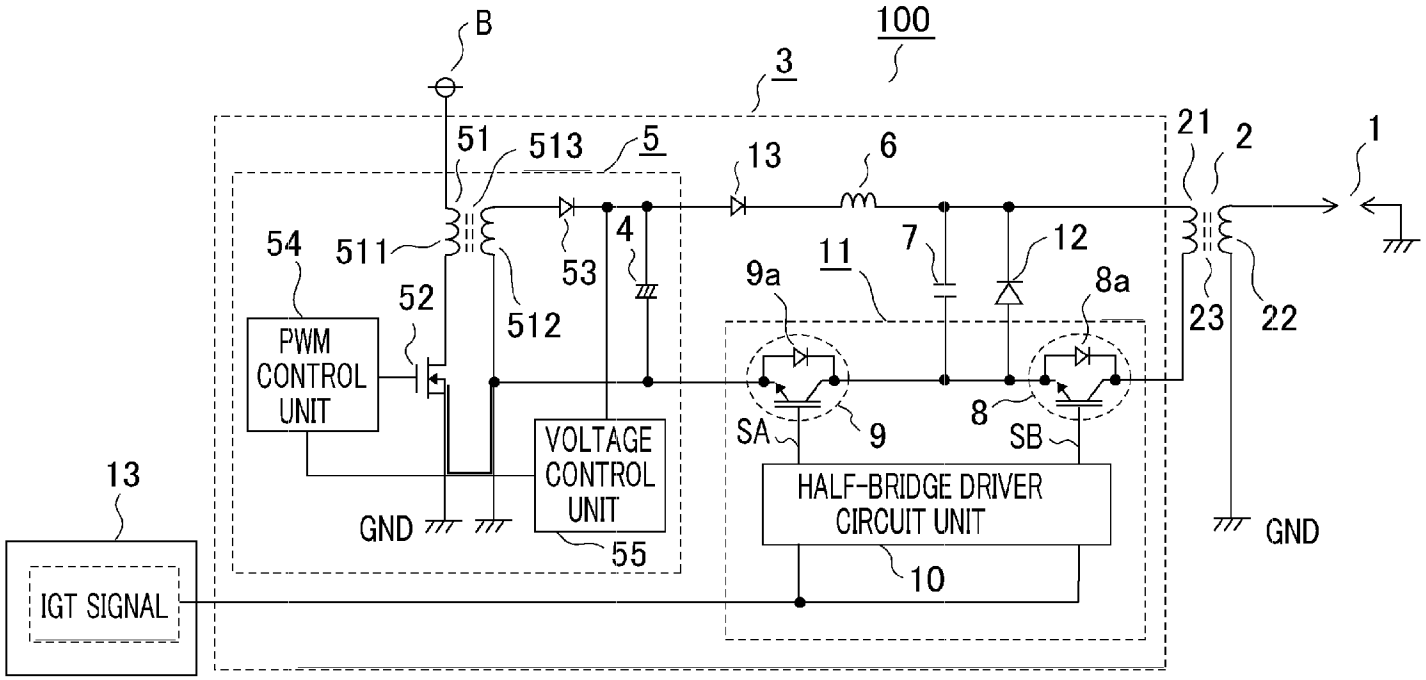
FIG. 1 is a circuit diagram of an internal combustion engine ignition apparatus according to Embodiment 1 of the present invention.

FIG. 1 is a circuit diagram illustrating an internal combustion engine ignition apparatus according to Embodiment 1 of the present invention. In FIG. 1, an ignition apparatus 100 includes an ignition plug 1 provided with a pair of electrodes that face each other through a predetermined gap, an ignition coil unit 2 having a primary coil 21 and a secondary coil 22 that are magnetically coupled with each other through an iron core 23, and an energy supply circuit 3 that supplies energy to the ignition coil unit 2.

The secondary coil 22 of the ignition coil unit 2 is connected between one of the electrodes of the ignition plug 1 and a vehicle ground potential unit (referred to as GND, hereinafter). One end of the primary coil 21 of the ignition coil unit 2 is connected with a resonance inductor 6 in the energy supply circuit 3, described later, and the positive-polarity terminal of an ignition condenser (referred to as a CDI condenser, hereinafter) 7, and the other end thereof is connected with the collector terminal of a second switching device 8 in a control circuit unit 11, described later.

The energy supply circuit 3 is provided with a power source circuit unit 5, the control circuit unit 11, a reverse-flow prevention diode 13, the resonance inductor 6, the CDI condenser 7, and a clamp diode 12, as a first diode. The resonance inductor 6 is connected, through the reverse-flow prevention diode 13, between the positive-polarity output terminal of the power source circuit unit 5 and the one end of the primary coil 21 of the ignition coil unit 2. The CDI condenser 7 and the clamp diode 12 are connected in parallel with each other, and are connected between the connection point between the resonance inductor 6 and the one end of the primary coil 21 and the emitter terminal of the second switching device 8.

The power source circuit unit 5 is configured with a transformer 51, a field-effect transistor, and the like; the power source circuit unit 5 further includes a power-source control switching device 52, a PWM control unit 54, a voltage control unit 55, a rectifier diode 53, and a large-capacity condenser 4, as a power source condenser. The primary coil 511 and the secondary coil 512 of the transformer 51 are magnetically coupled with each other through an iron core 513. The one end of the primary coil 511 is connected with the positive-polarity terminal B of a vehicle battery (unillustrated), and the other end thereof is connected with one end of a first switching device 52. The other end of the first switching device 52 is connected with GND.

The rectifier diode 53 rectifies the secondary current of the transformer 51 and supplies the rectified current to the large-capacity condenser 4. The PWM control unit 54 supplies a gate signal to the power-source control switching device 52 and on/off-controls the power-source control switching device 52 so as to PWM-controls the primary current of the transformer 51. The voltage control unit 55 feedbacks the voltage at the positive-polarity terminal of the large-capacity condenser 4 to the PWM control unit 54 and controls the PWM control unit 54 in such a way that the voltage across the large-capacity condenser 4 is kept at a predetermined value.

The control circuit unit 11 is provided with a first switching device 9, as a low-voltage-side switching device, the second switching device 8, as a high-voltage-side switching device, and a half-bridge driver circuit 10. The emitter terminal of the first switching device 9 is connected with the negative-polarity terminal of the large-capacity condenser 4 and GND. The emitter terminal of the second switching device 8 is connected with the collector terminal of the first switching device 9, and the collector terminal thereof is connected with the other terminal of the primary coil 21 of the ignition coil unit 2, described above.

The first switching device 9 and the second switching device 8 are each formed, for example, of an IGBT and are provided with body diodes 9*a* and 8*a*, respectively, that are each connected between the emitter and the collector thereof. The first switching device 9 and the second switching device 8 configure a half-bridge circuit. The first switching device 9 is on/off-controlled by a first gate signal SA supplied from the half-bridge driver circuit 10 to the gate thereof. The second switching device 8 is on/off-controlled through a second gate signal SB supplied from the half-bridge driver circuit 10 to the gate thereof. In the half-bridge driver circuit 10, the generation timings of the first and second gate signals SA and SB are controlled based on an ignition signal IGT from an engine control apparatus (referred to as an ECU, hereinafter) 13.

As described later, in the energy supply circuit 3 configured in such a way as described above, energy from the large-capacity condenser 4 is accumulated in the CDI condenser 7, based on an LC resonance phenomenon through the resonance inductor 6 and the CDI condenser 7, and the energy accumulated in the CDI condenser 7 is supplied to the ignition coil unit 2.

Figure 2:
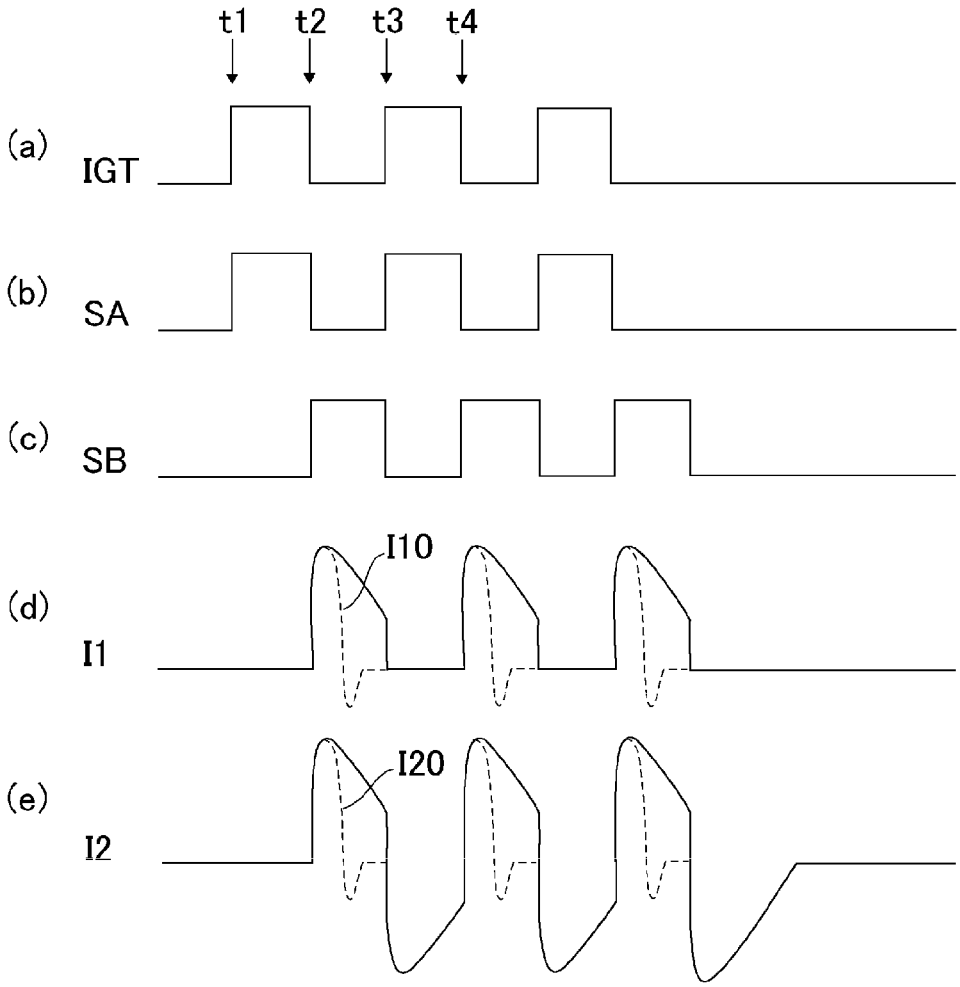
FIG. 2 is a timing chart representing the operation of an internal combustion engine ignition apparatus according to Embodiment 1 of the present invention.

Next, there will be explained the operation of the internal combustion engine ignition apparatus according to Embodiment 1 of the present invention. FIG. 2 is a timing chart representing the operation of an internal combustion engine ignition apparatus according to Embodiment 1 of the present invention; FIG. 2(*a*) is a waveform chart of the ignition signal IGT outputted from ECU 13; FIG. 2(*b*) is a waveform chart of the gate signal SA outputted from the half-bridge driver circuit 10; FIG. 2(*c*) is a waveform chart of the gate signal SB outputted from the half-bridge driver circuit 10; FIG. 2(*d*) is a waveform chart of a primary current I1 that flows in the primary coil 21 of the ignition coil unit 2; FIG. 2(*e*) is a waveform chart of a secondary current I2 that flows in the secondary coil 22 of the ignition coil unit 2.

In FIGS. 1 and 2, the large-capacity condenser 4 included in the power source circuit unit 5 is charged up to a predetermined voltage value, through the PWM control, of the primary current of the transformer 51, that is performed by the power-source control switching device 52. As represented in FIG. 2(*a*), the ignition signal IGT outputted from ECU 13 is a high level (referred to as H Level, hereinafter) during the period from a time point t1 to a time point t2, a low level (referred to as L Level, hereinafter) during the period from the time point t2 to a time point t3, and H Level during the period from the time point t3 to a time point t4; similarly, the ignition signal IGT alternately becomes H Level and L Level thereafter, and then is inputted to the half-bridge driver circuit 10.

As represented in FIG. 2(*b*), the first gate signal SA becomes H Level when the ignition signal IGT is H Level and becomes L Level when the ignition signal IGT is L Level. In contrast, as represented in FIG. 2(*c*), the second gate signal SB becomes L Level when the ignition signal IGT is H Level and becomes H Level when the ignition signal IGT is L Level.

When the ignition signal IGT becomes H Level at the time point t1, the first gate signal SA from the half-bridge driver 10 becomes H Level and hence the first switching device 9 turns on. As a result, energy preliminarily accumulated in the large-capacity condenser 4 of the power source circuit unit 5 is supplied to the CDI condenser 7. At this time, the CDI condenser 7 is rapidly charged up to a voltage that is approximately twice as high as the output voltage of the power source circuit unit 5, based on the LC resonance phenomenon through the resonance inductor 6 and the CDI condenser 7.

Next, at the time point t2, the ignition signal IGT outputted from ECU 13 becomes L Level. As a result, the second gate signal SB becomes H Level, and the first gate signal SA becomes L Level. Accordingly, the second switching device 8 turns on and the first switching device 9 turns off; thus, the electric charges on the CDI condenser 7, charged to a high voltage, are discharged through the primary coil 21 of the ignition coil unit 2, whereby as represented in FIG. 2(*d*), the primary current I1 steeply flows in the primary coil 21 of the ignition coil unit 2. As a result, a high voltage is induced across the secondary coil 22 of the ignition coil unit 2; this high voltage is transferred to the electrode of the ignition plug 1; a dielectric breakdown is caused between the electrodes of the ignition plug 1 and hence a spark discharge occurs; then, a discharge current based on the secondary current I2 flows. This spark discharge causes an inflammable fuel-air mixture in the combustion chamber of the internal combustion engine to be ignited and combust.

Here, in order to understand the operation of the clamp diode 12, there will be described a case where the clamp diode 12, as the first diode, is not provided. In this case, when the polarity of the primary current I1 flowing in the primary coil 21 changes to be negative during the period from the time point t2 to the time point t3, the high-voltage side of the primary coil 21 connected with the CDI condenser 7 swings largely to a negative potential; the collector potential of the second switching device 8 becomes negative; before the second gate signal SB from the half-bridge driver circuit 10 becomes L Level, the second switching device 8 is forcibly turned off; as represented by a broken line I10 in FIG. 2(*d*), the primary current I1 flows in the negative direction through the body diode 8*a* of the second switching device 8, whereby as represented by a broken line 120 in FIG. 2(*e*), the secondary current I2 decreases and flows in the negative direction; as a result, continuous discharge between the electrodes of the ignition plug 1 cannot be performed.

In contrast, because, in fact, the clamp diode 12 is provided, the high-voltage side of the primary coil 21 is prevented from being swung to a negative potential, as described above; the second switching device 8 is kept on till the time point t3 at which the second gate signal SB from the half-bridge driver circuit 10 becomes L Level; the secondary current I2 flows as represented by a solid line in FIG. 2(*e*); thus, discharge between the electrodes of the ignition plug 1 can continuously be performed.

Next, at the time point t3, the ignition signal IGT from ECU 13 becomes H Level again; the first gate signal SA from the half-bridge driver circuit 10 becomes H Level, and the second gate signal SB becomes L Level. Accordingly, the first switching device 9 turns on, and the second switching device 8 turns off. As a result, because the primary current I1 of the ignition coil unit 2 is immediately cut off, a reverse-polarity high voltage is induced across the secondary coil 22, whereby as represented in FIG. 2(*e*), the secondary current I2 having a negative direction flows in the secondary coil 22 of the ignition coil unit 2; thus, a spark discharge having a direction that is contrary to the direction of the foregoing spark discharge is caused between the electrodes of the ignition plug 1 and hence a discharge current flows. This discharge current continues to flow till the time point t4 at which the ignition signal IGT becomes L Level.

During the period from the time point t3 to the time point t4, the first switching device 9 turns on, and the second switching device 8 turns off; therefore, the CDI condenser 7 is rapidly charged again up to a voltage that is approximately twice as high as the output voltage of the power source circuit unit 5, based on the LC resonance phenomenon through the resonance inductor 6 and the CDI condenser 7.

After the time point t4, the foregoing operation items during the period from the time point t2 to the time point t3 and during the period from the time point t3 to the time point t4 are repeated; thus, a discharge current alternately and continuously flows through the gap between the electrodes of the ignition plug 1. As a result, the secondary current I2, which alternately and continuously flows, ignites the inflammable fuel-air mixture in the combustion chamber of the internal combustion engine.

As described above, the internal combustion engine ignition apparatus according to Embodiment 1 of the present invention enables the CDI condenser to be rapidly charged; therefore, even when the energy supply circuit is formed of only a single circuit, for example, a single CDI condenser circuit, a plurality of cylinders can be supplied with energy. In other words, even when there exist two or more cylinders, the energy supply source can be shared; therefore, the apparatus can be downsized and the cost therefor can be reduced.

Embodiment 2

Figure 3:
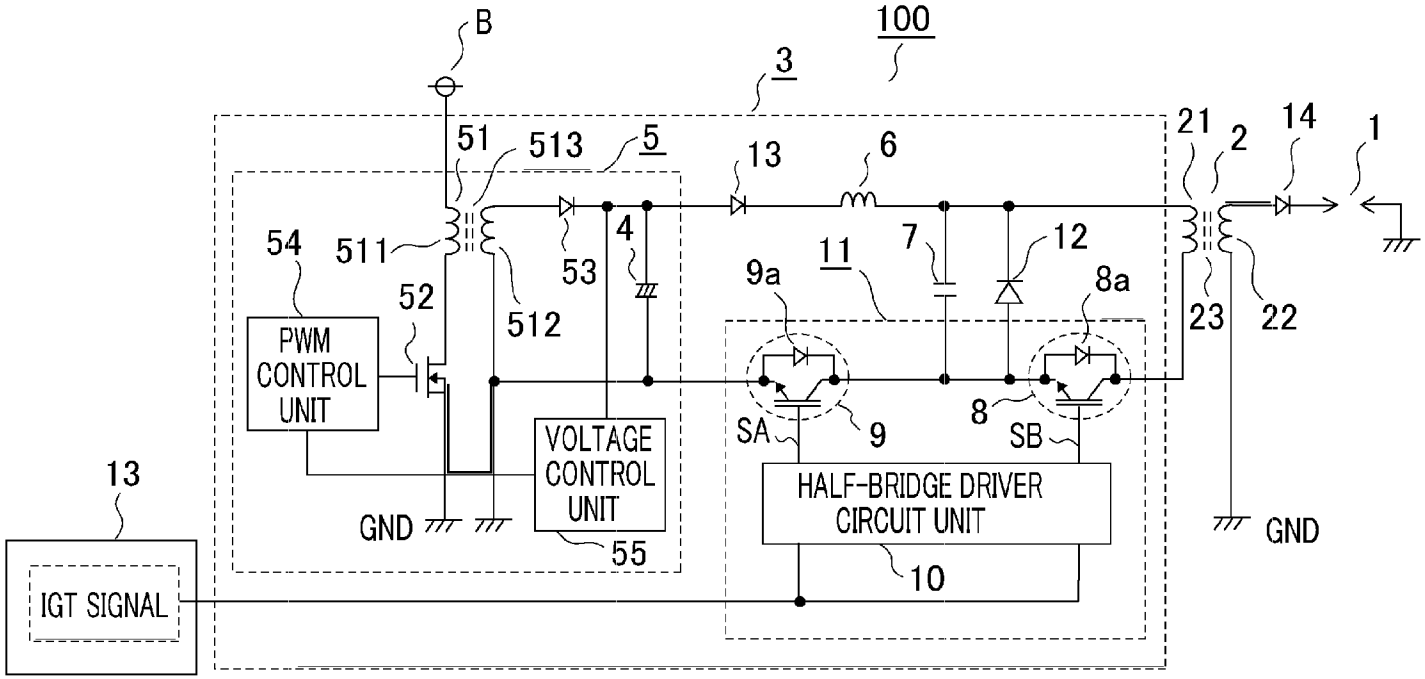
FIG. 3 is a circuit diagram of an internal combustion engine ignition apparatus according to Embodiment 2 of the present invention.

Next, there will be explained an internal combustion engine ignition apparatus according to Embodiment 2 of the present invention. FIG. 3 is a circuit diagram of an internal combustion engine ignition apparatus according to Embodiment 2 of the present invention. In FIG. 3, a rectifier diode 14 is inserted into the secondary coil 22 of the ignition coil unit 2. That is to say, one end of the secondary coil 22 is connected with the anode of the rectifier diode 14, and one electrode of the ignition plug 1 is connected with the cathode of the rectifier diode 14. The other configurations are the same as those in FIG. 1.

Figure 4:
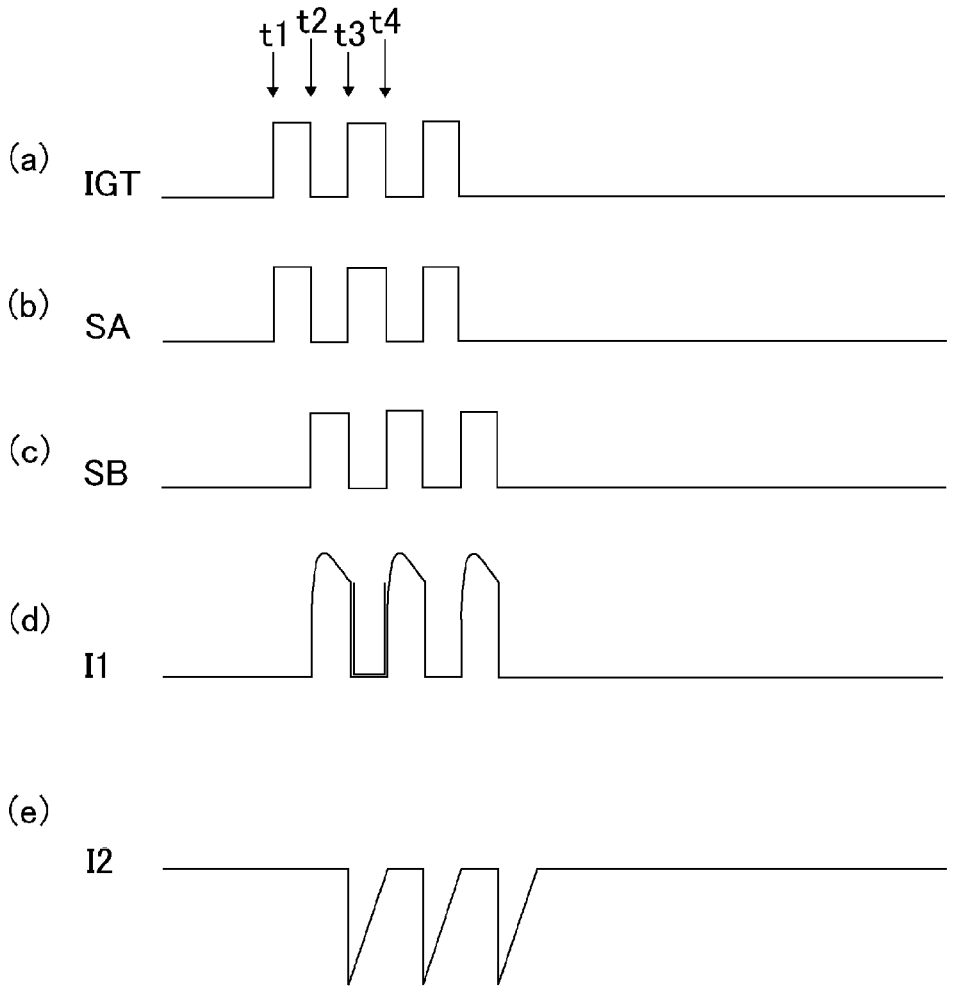
FIG. 4 is a timing chart representing the operation of an internal combustion engine ignition apparatus according to Embodiment 2 of the present invention.

FIG. 4 is a timing chart representing the operation of an internal combustion engine ignition apparatus according to Embodiment 2 of the present invention; FIG. 4(*a*) is a waveform chart of the ignition signal IGT outputted from ECU 13; FIG. 4(*b*) is a waveform chart of the gate signal SA outputted from the half-bridge driver circuit 10; FIG. 4(*c*) is a waveform chart of the gate signal SB outputted from the half-bridge driver circuit 10; FIG. 4(*d*) is a waveform chart of the primary current I1 that flows in the primary coil 21 of the ignition coil unit 2; FIG. 4(*e*) is a waveform chart of the secondary current I2 that flows in the secondary coil 22 of the ignition coil unit 2.

In FIGS. 3 and 4, the large-capacity condenser 4 included in the power source circuit unit 5 is charged up to a predetermined voltage value, through the PWM control, of the primary current of the transformer 51, that is performed by the power-source control switching device 52. As represented in FIG. 4(*a*), the ignition signal IGT outputted from ECU 13 is H Level during the period from the time point t1 to the time point t2, LOW LEVEL during the period from the time point t2 to the time point t3, and H Level during the period from the time point t3 to the time point t4; similarly, the ignition signal IGT alternately becomes H Level and L Level thereafter, and then is inputted to the half-bridge driver circuit 10.

As represented in FIG. 4(*b*), the first gate signal SA becomes H Level when the ignition signal IGT is H Level and becomes L Level when the ignition signal IGT is L Level. In contrast, as represented in FIG. 4(*c*), the second gate signal SB becomes L Level when the ignition signal IGT is H Level and becomes H Level when the ignition signal IGT is L Level.

When the ignition signal IGT becomes H Level at the time point t1, the first gate signal SA from the half-bridge driver circuit 10 becomes H Level and hence the first switching device 9 turns on. As a result, energy preliminarily accumulated in the large-capacity condenser 4 of the power source circuit unit 5 is supplied to the CDI condenser 7. At this time, the CDI condenser 7 is rapidly charged up to a voltage that is approximately twice as high as the output voltage of the power source circuit unit 5, based on the LC resonance phenomenon through the resonance inductor 6 and the CDI condenser 7.

Next, at the time point t2, the ignition signal IGT outputted from ECU 13 becomes L Level. As a result, the second gate signal SB becomes H Level, and the first gate signal SA becomes L Level. Accordingly, the second switching device 8 turns on and the first switching device 8 turns off; thus, the electric charges on the CDI condenser 7, charged to a high voltage, are discharged through the primary coil 21 of the ignition coil unit 2, whereby as represented in FIG. 4(*d*), the primary current I1 steeply flows in the primary coil 21 of the ignition coil unit 2. As a result, a high voltage is induced across the secondary coil 22 of the ignition coil unit 2; however, because as described above, the rectifier diode 14 is connected with the secondary coil 22, the high voltage induced across the secondary coil 22 is not applied to the electrodes of the ignition plug 1. Accordingly, as represented in FIG. 4(*e*), the secondary current I2 does not flow, whereby no spark discharge is caused between the electrodes of the ignition plug 1.

Next, at the time point t3, the ignition signal IGT from ECU 13 becomes H Level again; the first gate signal SA from the half-bridge driver circuit 10 becomes H Level, and the second gate signal SB becomes L Level. Accordingly, the first switching device 9 turns on, and the second switching device 8 turns off. As a result, because the primary current I1 of the ignition coil unit 2 is immediately cut off, a reverse-polarity high voltage is induced across the secondary coil 22 and is applied to a gap between the electrodes of the ignition plug 1; then, a dielectric breakdown is caused between the electrodes, whereby a spark discharge occurs. As a result, as represented in FIG. 4(*e*), the secondary current I2 having a negative polarity flows, as a discharge current, through the secondary coil 22 and the gap between the electrodes of the ignition plug 1; this flow continues till the time point t4 at which the ignition signal IGT becomes L Level.

During the period from the time point t3 to the time point t4, the first switching device 9 turns on, and the second switching device 8 turns off; therefore, the CDI condenser 7 is rapidly charged again up to a voltage that is approximately twice as high as the output voltage of the power source circuit unit 5, based on the LC resonance phenomenon through the resonance inductor 6 and the CDI condenser 7.

After the time point t4, the foregoing operation items during the period from the time point t2 to the time point t3 and during the period from the time point t3 to the time point t4 are repeated; thus, a high voltage is intermittently applied to the gap between the electrodes of the ignition plug 1; then, a spark discharge intermittently occurs through the gap between the electrodes of the ignition plug 1, whereby high-speed and intermittent multi-ignition can be performed.

As is well known, in the case of the capacitive-discharging-method ignition apparatus, i.e., the CDI ignition method, the primary current becomes the same as or larger than 50[A], which is larger than the primary current based on an ordinary full-transistor method; therefore, by replacing the CDI ignition method by the full-transistor method, a high voltage and a large current can be supplied to the secondary coil, even when the turn ratio of the secondary coil to the primary coil of the ignition coil unit is reduced; thus, the ignition coil unit can be downsized. Moreover, in the plasma jet ignition method or the high-frequency plasma ignition method, because a high voltage and a large current are supplied to the ignition plug, two components, i.e., a trigger ignition coil for generating the high voltage and a power source circuit for supplying the large current are required; however, in the ignition apparatus according to Embodiment 2, the trigger ignition coil is not required and hence the number of the foregoing components can be decreased to one, whereby the ignition apparatus according to Embodiment 2 can be downsized and the cost therefor can be reduced in comparison with an ignition apparatus according to a conventional ignition method.

As described above, the internal combustion engine ignition apparatus according to Embodiment 2 of the present invention enables the CDI condenser to be rapidly charged; therefore, even when the energy supply circuit is formed of only a single circuit, for example, a single CDI condenser circuit, a plurality of cylinders can be supplied with energy. In other words, even when there exist two or more cylinders, the energy supply source can be shared; therefore, the apparatus can be downsized and the cost therefor can be reduced.

Embodiment 3

Figure 5:
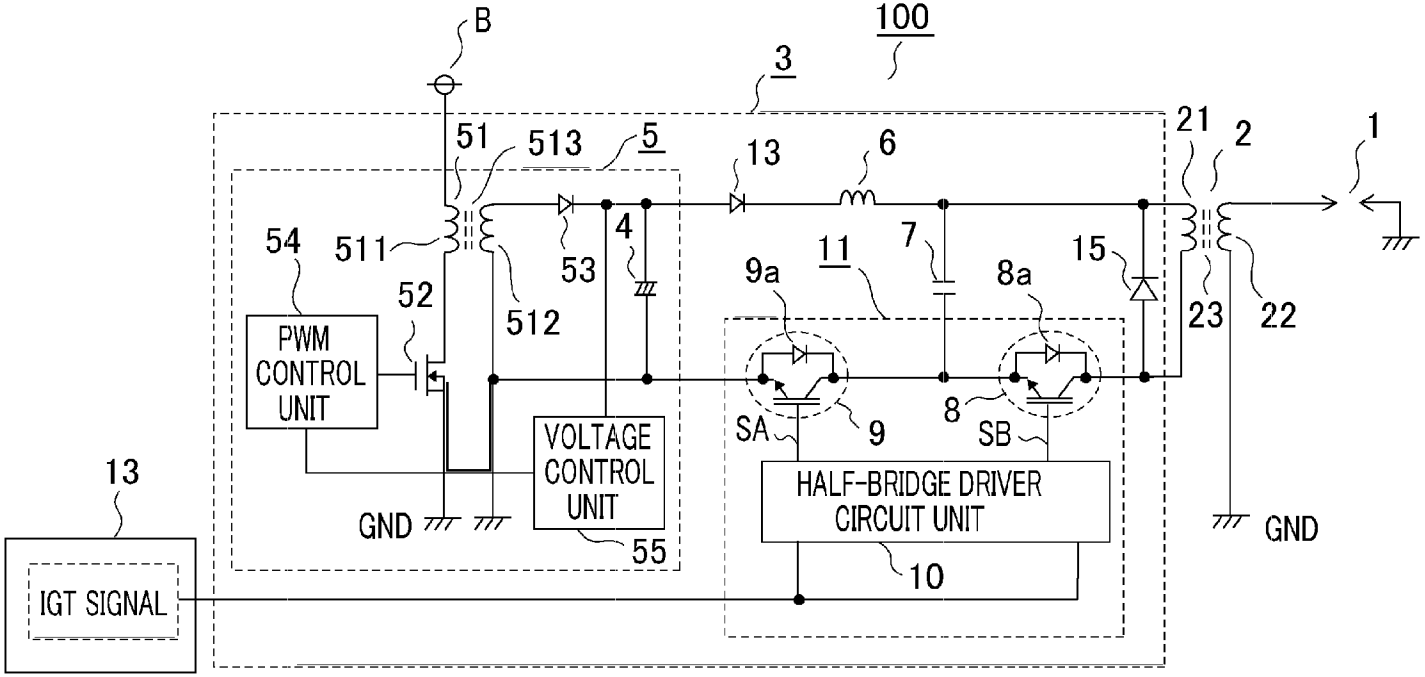
FIG. 5 is a circuit diagram of an internal combustion engine ignition apparatus according to Embodiment 3 of the present invention.

Next, there will be explained an internal combustion engine ignition apparatus according to Embodiment 3 of the present invention. FIG. 5 is a circuit diagram of an internal combustion engine ignition apparatus according to Embodiment 3 of the present invention. In Embodiment 3, instead of the first diode 12, as the clamp diode in Embodiment 1 or Embodiment 2, a circulation diode 15 is provided, as a second diode. The anode of the circulation diode 15 is connected with the one end of the primary coil 21 of the ignition coil unit 2, and the cathode thereof is connected with the collector terminal of the second switching device 8. The other configurations are the same as those in Embodiment 1.

Figure 6:
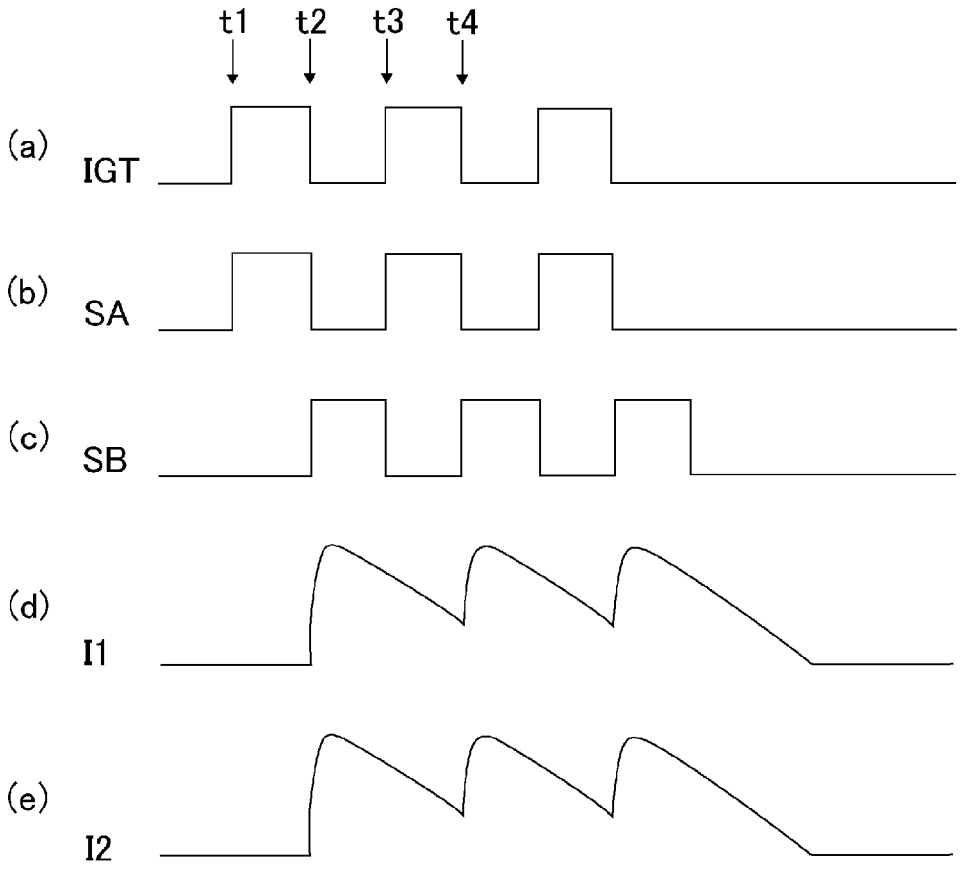
FIG. 6 is a timing chart representing the operation of an internal combustion engine ignition apparatus according to Embodiment 3 of the present invention.

FIG. 6 is a timing chart representing the operation of an internal combustion engine ignition apparatus according to Embodiment 3 of the present invention; FIG. 6(*a*) is a waveform chart of the ignition signal IGT outputted from ECU 13; FIG. 6(*b*) is a waveform chart of the gate signal SA outputted from the half-bridge driver circuit 10; FIG. 6(*c*) is a waveform chart of the gate signal SB outputted from the half-bridge driver circuit 10; FIG. 6(*d*) is a waveform chart of the primary current I1 that flows in the primary coil 21 of the ignition coil unit 2; FIG. 6(*e*) is a waveform chart of the secondary current I2 that flows in the secondary coil 22 of the ignition coil unit 2.

In FIGS. 5 and 6, the large-capacity condenser 4 included in the power source circuit unit 5 is charged up to a predetermined voltage value, through the PWM control, of the primary current of the transformer 51, that is performed by the power-source control switching device 52. As represented in FIG. 6(*a*), the ignition signal IGT outputted from ECU 13 is a high level (referred to as H Level, hereinafter) during the period from the time point t1 to the time point t2, a low level (referred to as L Level, hereinafter) during the period from the time point t2 to the time point t3, and H Level during the period from the time point t3 to the time point t4; similarly, the ignition signal IGT alternately becomes H Level and L Level thereafter, and then is inputted to the half-bridge driver circuit 10.

As represented in FIG. 6(*b*), the first gate signal SA becomes H Level when the ignition signal IGT is H Level and becomes L Level when the ignition signal IGT is L Level. In contrast, as represented in FIG. 6(*c*), the second gate signal SB becomes L Level when the ignition signal IGT is H Level and becomes H Level when the ignition signal IGT is L Level.

When the ignition signal IGT becomes H Level at the time point t1, the first gate signal SA from the half-bridge driver circuit 10 becomes H Level and hence the first switching device 9 turns on. As a result, energy preliminarily accumulated in the large-capacity condenser 4 of the power source circuit unit 5 is supplied to the CDI condenser 7. At this time, the CDI condenser 7 is rapidly charged up to a voltage that is approximately twice as high as the output voltage of the power source circuit unit 5, based on the LC resonance phenomenon through the resonance inductor 6 and the CDI condenser 7.

Next, at the time point t2, the ignition signal IGT outputted from ECU 13 becomes L Level. As a result, the second gate signal SB becomes H Level, and the first gate signal SA becomes L Level. Accordingly, the second switching device 8 turns on and the first switching device 8 turns off; thus, the electric charges on the CDI condenser 7, charged to a high voltage, are discharged through the primary coil 21 of the ignition coil unit 2, whereby as represented in FIG. 6(*d*), the primary current I1 steeply flows in the primary coil 21 of the ignition coil unit 2. As a result, a high voltage is induced across the secondary coil 22 of the ignition coil unit 2; this high voltage is transferred to the electrode of the ignition plug 1; a dielectric breakdown is caused between the electrodes of the ignition plug 1 and hence a spark discharge occurs; then, a discharge current based on the secondary current I2 flows. This spark discharge causes an inflammable fuel-air mixture in the combustion chamber of the internal combustion engine to be ignited and combust.

Next, at the time point t3, the ignition signal IGT from ECU 13 becomes H Level again; the first gate signal SA from the half-bridge driver circuit 10 becomes H Level, and the second gate signal SB becomes L Level. Accordingly, the first switching device 9 turns on, and the second switching device 8 turns off; however, while circulating in the primary coil 21 through the circulation diode 15, the primary current I1 of the ignition coil unit 2 gradually decreases, as represented in FIG. 6(*d*). As a result, as represented in FIG. 6(*e*), the secondary current I2 flows in the secondary coil 22 of the ignition coil unit 2 also in a gradually decreasing manner, and a discharge current in the gap between the electrodes of the ignition plug 1 continues to flow in a decreasing manner till the time point t4 at which the ignition signal IGT becomes L Level.

During the period from the time point t3 to the time point t4, the first switching device 9 turns on, and the second switching device 8 turns off; therefore, the CDI condenser 7 is rapidly charged again up to a voltage that is approximately twice as high as the output voltage of the power source circuit unit 5, based on the LC resonance phenomenon through the resonance inductor 6 and the CDI condenser 7.

After the time point t4, the foregoing operation items during the period from the time point t2 to the time point t3 and during the period from the time point t3 to the time point t4 are repeated; thus, the secondary current I2 continuously flows in a direct-current manner through the gap between the electrodes of the ignition plug 1, whereby the ignition can be sustained.

As described above, the internal combustion engine ignition apparatus according to Embodiment 3 of the present invention enables the CDI condenser to be rapidly charged; therefore, even when the energy supply circuit is formed of only a single circuit, for example, a single CDI condenser circuit, a plurality of cylinders can be supplied with energy. In other words, even when there exist two or more cylinders, the energy supply source can be shared; therefore, the apparatus can be downsized and the cost therefor can be reduced.

Various modifications and alterations of this invention will be apparent to those skilled in the art without departing from the scope and spirit of this invention, and it should be understood that this is not limited to the illustrative embodiments set forth herein.

What is claimed is:

1. An internal combustion engine ignition apparatus comprising:

a power source circuit unit that generates a predetermined output;

a resonance inductor connected with an output terminal of the power source circuit unit;

an ignition condenser that is charged with the predetermined output of the power source circuit unit by way of the resonance inductor;

an ignition coil unit provided with a primary coil whose one end is connected with a positive-polarity terminal of the ignition condenser and a secondary coil that is magnetically coupled with the primary coil and generates an ignition voltage when energy produced through discharge of the ignition condenser is supplied thereto;

an ignition plug that is provided with a pair of electrodes facing each other through a gap, one of the pair of electrodes of which is connected with the secondary coil, and that causes a spark discharge between the electrodes when the ignition voltage is applied across the pair of electrodes so as to ignite an inflammable fuel-air mixture supplied to an internal combustion engine;

a control circuit unit provided with a first switching device placed in a charging path through which the ignition condenser is charged and a second switching device whose collector terminal is connected with the other end of the primary coil and whose emitter terminal is connected with a negative-polarity terminal of the ignition condenser; and a first diode connected between the one end of the primary coil and the emitter terminal of the second switching device, wherein based on an ignition signal for the internal combustion engine from the outside, the control circuit unit turns on the first switching device so that the ignition condenser is charged, and based on the ignition signal, the control circuit unit turns on the second switching device so that the ignition condenser is discharged.

2. The internal combustion engine ignition apparatus according to claim 1, further including a rectifier diode connected in series with the secondary coil of the ignition coil unit.

3. The internal combustion engine ignition apparatus according to claim 1, wherein the control circuit unit controls the first switching device and the second switching device in such a way that when one of the first switching device and the second switching device is on, the other one becomes off.

4. The internal combustion engine ignition apparatus according to claim 1, wherein the internal combustion engine is provided with a plurality of cylinders; a pair of the ignition coil unit and the ignition plug is provided for each corresponding one of the plurality of cylinders; and the ignition condenser supplies each of the plurality of ignition coil units with the energy.

5. The internal combustion engine ignition apparatus according to claim 1, wherein the first switching device is connected between the negative-polarity terminal of the ignition condenser and a ground connection and turned off by a first gate signal while the second switching device being turned on by a second gate signal, the first gate signal and the second gate signal having 50% duty cycles.

6. An internal combustion engine ignition apparatus comprising:

an ignition condenser that is charged with an output of a power source circuit unit;

an ignition coil unit provided with a primary coil whose one end is connected with a positive-polarity terminal of the ignition condenser and a secondary coil that is magnetically coupled with the primary coil and generates an ignition voltage when energy produced through discharge of the ignition condenser is supplied thereto;

an ignition plug that is provided with a pair of electrodes facing each other through a gap, one of the pair of electrodes of which is connected with the secondary coil, and that causes a spark discharge between the electrodes when the ignition voltage is applied across the pair of electrodes so as to ignite an inflammable fuel-air mixture supplied to an internal combustion engine;

a control circuit unit provided with a first switching device controlled by the control circuit unit to charge the ignition condenser and a second switching device whose collector terminal is connected with the other end of the primary coil and whose emitter terminal is connected with a negative-polarity terminal of the ignition condenser, and a half-bridge driver circuit configured to receive an ignition signal and control a gate voltage level of the first switching device and a gate voltage level of the second switching device based on the ignition signal a first diode connected between the one end of the primary coil and the emitter terminal of the second switching device, wherein based on the ignition signal for the internal combustion engine from the outside, the control circuit unit controls the first switching device so that the ignition condenser is charged, and based on the ignition signal, the control circuit unit turns on the second switching device so that the ignition condenser is discharged.

7. The internal combustion engine ignition apparatus according to claim 6, the first diode is provided to prevent the second switching device from being forcibly turned off while the control circuit unit is applying a turn-on signal to the second switching device.

* * * * *